US007283033B2

(12) United States Patent
Wang et al.

(10) Patent No.: US 7,283,033 B2
(45) Date of Patent: Oct. 16, 2007

(54) AXIAL LEADED OVER-CURRENT PROTECTION DEVICE

(75) Inventors: Shau Chew Wang, Taipei (TW); Yi Nuo Chen, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 219 days.

(21) Appl. No.: 11/219,657

(22) Filed: Sep. 7, 2005

(65) Prior Publication Data

US 2006/0056125 A1 Mar. 16, 2006

(30) Foreign Application Priority Data

Sep. 10, 2004 (CN) ..... 2004 2 0074143

(51) Int. Cl.
*H01C 7/10* (2006.01)
*H01C 7/13* (2006.01)

(52) U.S. Cl. ..... 338/22 R; 338/307; 338/320

(58) Field of Classification Search ..... 338/22 R, 338/320, 328, 327, 20, 232–234, 307
See application file for complete search history.

(56) References Cited

U.S. PATENT DOCUMENTS 4,635,026 A * 1/1987 Takeuchi ..... 338/22 SD
5,493,266 A * 2/1996 Sasaki et al. ..... 338/22 R
5,777,541 A * 7/1998 Vekeman ..... 338/22 R
5,990,779 A * 11/1999 Katsuki et al. ..... 338/232
6,025,771 A * 2/2000 Kobayashi et al. ..... 338/22 R
6,150,918 A * 11/2000 Berger ..... 338/22 R
6,215,388 B1 * 4/2001 West ..... 338/22 R
6,242,997 B1 * 6/2001 Barrett et al. ..... 338/22 R
6,751,862 B2 * 6/2004 Hamatani et al. ..... 29/854

* cited by examiner

*Primary Examiner*—K. Richard Lee
(74) *Attorney, Agent, or Firm*—Volentine & Whitt, PLLC

(57) ABSTRACT

An axial leaded over-current protection device comprised of a plurality of PTC devices, a first terminal metal strip, and a second terminal metal strip. One end of the first terminal metal strip diverges into a plurality of electrode strips, and the plurality electrode strips are connected to an electrode layer of each PTC device. The second terminal metal strip is connected to the other electrode layer of each PTC device, i.e., the one not being connected to the first terminal metal strip. Accordingly, the first terminal metal strip and second terminal metal strip are respectively connected to the two electrode layers of each PTC device and become in parallel thereby, so that the resistance of the over-current protection device can be decreased.

6 Claims, 6 Drawing Sheets

AXIAL LEADED OVER-CURRENT PROTECTION DEVICE

BACKGROUND OF THE INVENTION (A) Field of the Invention

The present invention is related to an axial leaded over-current protection device, more specifically, to an axial leaded over-current protection device of a positive temperature coefficient (PTC).

(B) Description of the Related Art

The resistance of a positive temperature coefficient (PTC) conductive material is sensitive to temperature variation and can be kept extremely low during normal operation so that the circuit can operate normally. However, if an over-current or an over-temperature event occurs, the resistance will immediately increase to a high resistance state (e.g., above $10^4$ ohm.) Therefore, the over-current will be eliminated and the objective to protect the circuit device will be achieved. Consequently, PTC devices have been commonly integrated into various circuitries so as to prevent the damage caused by over-current.

FIG. 1(*a*) illustrates a perspective diagram of a known over-current protection device 10. Two terminal metal strips 11 are respectively soldered to the upper and lower surfaces of a PTC element 12 and are used as connection interfaces to the appliance to be protected. FIG. 1(*b*) is the side view of the over-current protection device 10. The PTC element 12 is composed of two electrode layers 121 and a PTC material layer 122 laminated therebetween, and the two terminal metal strips 11 are respectively connected to the two electrode layer 121.

An over-current protection device is usually expected to lower its initial resistance as far as possible, so as to be used in low resistance applications. However, the area of the PTC element would increase when it is attempting to lower the resistance. Therefore, the over-current protection device is unsuitable for being used in small appliances as a result of the dimension increase of the over-current protection device.

SUMMARY OF THE INVENTION

The objective of the present invention is to provide an axial leaded over-current protection device of low resistance in an attempt to enlarge the applications thereof. For instance, according to the new development of a battery, an insulation cap is often formed on the top of the battery body by injection molding. However, because the process temperature of injection molding is relatively high, the over-current protection device on the battery would be tripped. If the recovery of the over-current protection device is worse after being tripped, the applications of the over-current protection device are tremendously limited due to its high initial resistance.

Moreover, the volume of the over-current protection device of the present invention does not increase significantly, so that it can be used in small appliances.

To achieve the above-mentioned objective, an axial leaded over-current protection device is disclosed. The axial leaded over-current protection device comprises a plurality of PTC devices, a first terminal metal strip and a second terminal metal strip, where the PTC device is constituted of two electrode layers and a PTC material layer laminated therebetween. And the plurality of PTC devices are in the form of a stack strap structure. One end of the first terminal metal strip diverges into a plurality of electrode strips, and the plurality of electrode strips are connected to an electrode layer of each PTC device. The second terminal metal strip is connected to the other electrode layer of each PTC device. Accordingly, the first terminal metal strip and second terminal metal strip are respectively connected to the two electrode layers of each PTC device and thereby the PTC devices are connected in parallel so that the resistance of the over-current protection device will be decreased.

DETAILED DESCRIPTION OF THE INVENTION

Figure 1A:
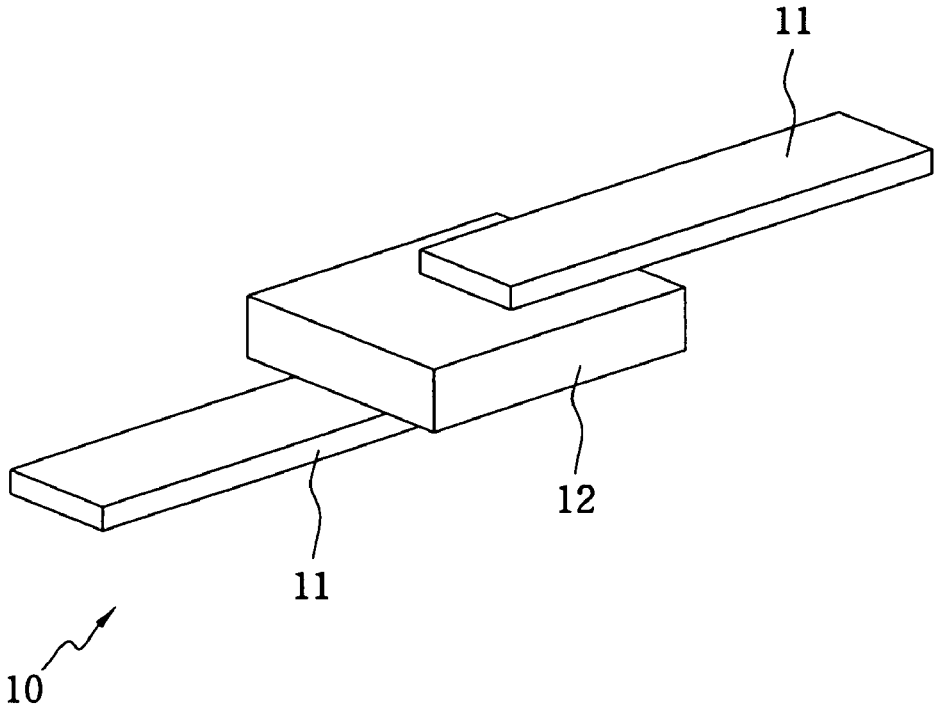
FIG. 1(a) (Background Art)
FIGS. 1(*a*) and 1(*b*) illustrate a known axial leaded over-current protection device.
Figure 1B:
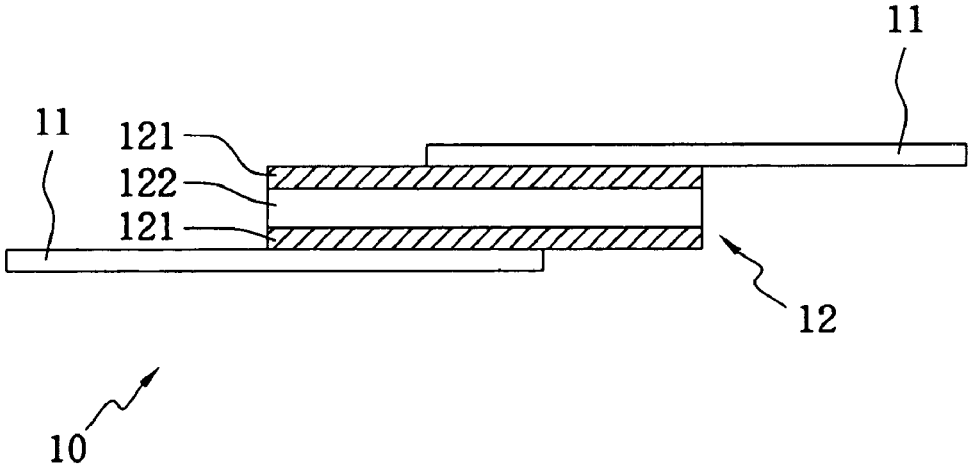
FIG. 1(b) (Background Art)
Figure 2A:
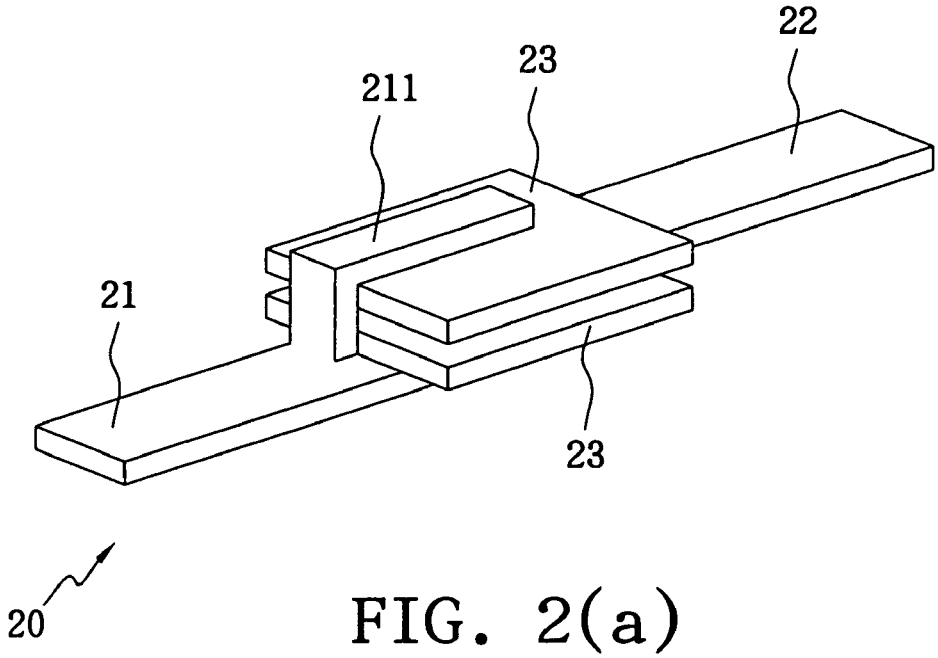
FIGS. 2(*a*) and 2(*b*) illustrate the perspective view and the side view of an axial leaded over-current protection device of the first embodiment in accordance with the present invention.
Figure 2B:
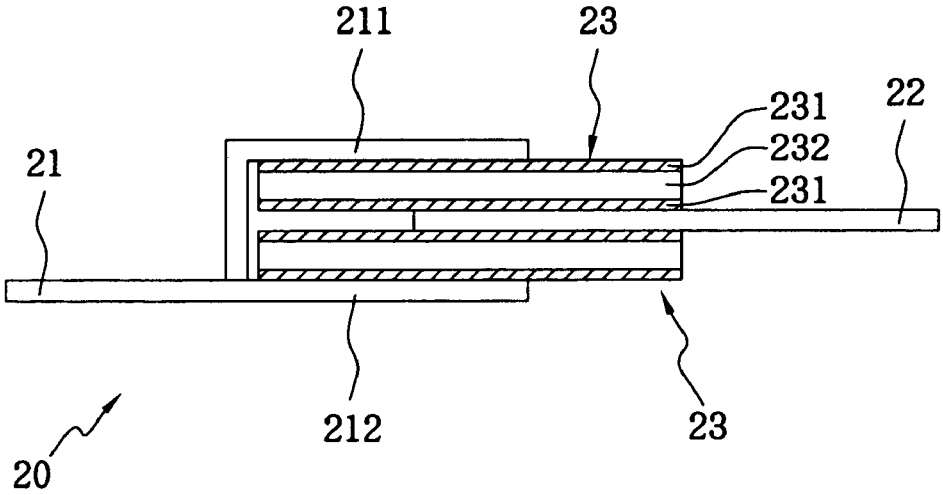

FIG. 2(*a*) illustrates an axial leaded over-current protection device 20 of an embodiment in accordance with the present invention. FIG. 2(*b*) illustrates the side view of the axial leaded over-current protection device 20. In view of shape, such axial leaded device is also named a strap device. The axial leaded over-current protection device 20, in the form of a strap, comprises a first terminal metal strip 21, a second terminal metal strip 22 and two PTC devices 23. The PTC device 23 is constituted of two electrode layers 231 and a PTC material layer 232 laminated therebetween. The PTC devices 23 are in the form of a stack strap structure. One end of the first terminal metal strip 21 diverges into two electrode strips 211 and 212, which are respectively connected to one of the electrode layers 231 (first electrode layer) of the two PTC devices 23. The second terminal metal strip 22 is connected to the other electrode layers 231 (second electrode layers) of the two PTC devices 23, i.e., the second terminal metal strip 22 is connected to the electrode layers 231 that are not connected to the first terminal metal strip 21. Accordingly, the two PTC devices 23 are connected in parallel, so as to decrease the resistance of the over-current protection device 20.

Figure 3A:
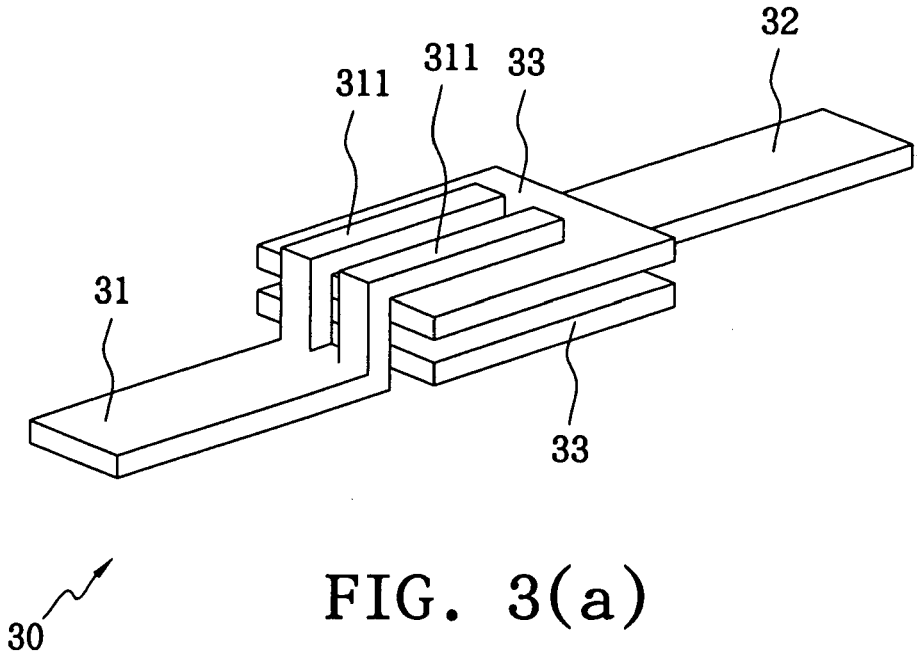
FIGS. 3(*a*) and 3(*b*) illustrate the perspective view and the side view of an axial leaded over-current protection device of the second embodiment in accordance with the present invention.
Figure 3B:
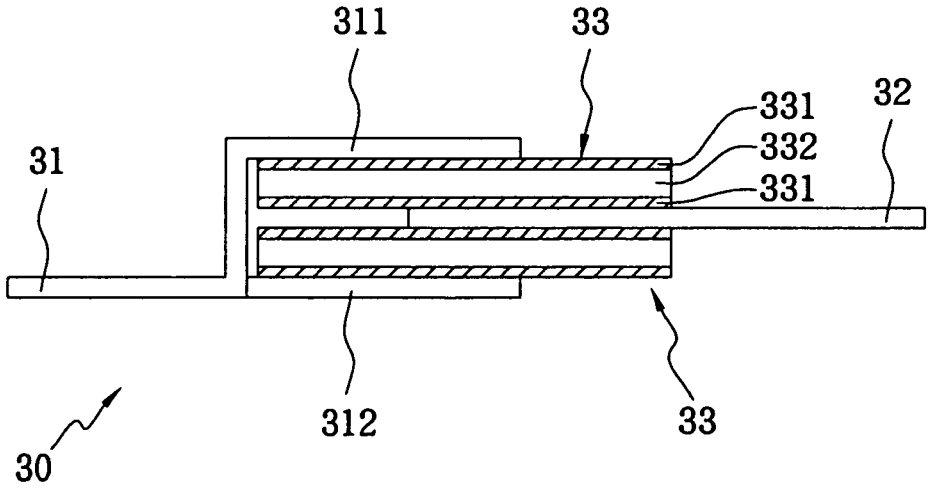

FIGS. 3(*a*) and 3(*b*) illustrate another axial leaded over-current protection device including two PTC devices. An axial leaded over-current protection device 30 comprises a first terminal metal strip 31, a second terminal metal strip 32 and two PTC devices 33. The PTC device 33 is constituted of two electrode layers 331 and a PTC material layer 332 laminated therebetween. One end of the first terminal metal strip 31 diverges into two electrode strips 311 and a strip 312, wherein the two electrode strips 311 are connected to the top electrode layer 331 of the upper PTC device 33, whereas the electrode strip 312 is connected to the bottom electrode layer 331 of the lower PTC device 33. The second terminal metal strip 32 is connected to the electrode layers 331, which are not connected to the first terminal metal strip 31, of the two PTC devices 33.

The above embodiments are relevant to the over-current protection device including two PTC devices. In practice, the over-current protection device may contain more PTC devices to acquire lower resistance. The over-current protection devices including three to six PTC devices are exemplified as follows. The connection manner of the diverged terminal metal strip is crucial in accordance with the present invention, but the divergence patterns of the terminal metal strip as shown in FIGS. 2(*a*) and 3(*a*) are not the key points of the present invention, thus the following embodiments are only illustrated in side views.

Figure 4:
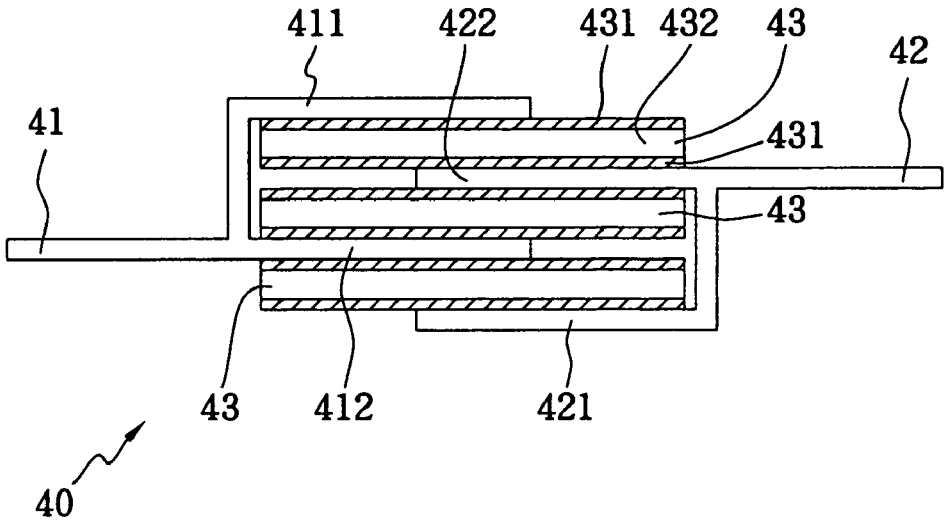
FIG. 4 illustrates an axial leaded over-current protection device of the third embodiment in accordance with the present invention.

Referring to FIG. 4, an axial leaded over-current protection device 40 comprises three PTC devices 43, a first terminal metal strip 41 and a second terminal metal strip 42. The PTC device 43 is constituted of two electrode layers 431 and a PTC material layer 432 laminated therebetween. Likewise, one end of the first terminal metal strip 41 diverges into two electrode strips 411 and 412, which are respectively connected to some of the electrode layers 431 (first electrode layer) of the three PTC devices. One end of the second terminal metal strip 42 also diverges into two electrode strips 421 and 422, which are respectively connected to the other electrode layers 431 (second electrode layers), i.e., the ones not being connected to the first terminal metal strip 41.

Figure 5:
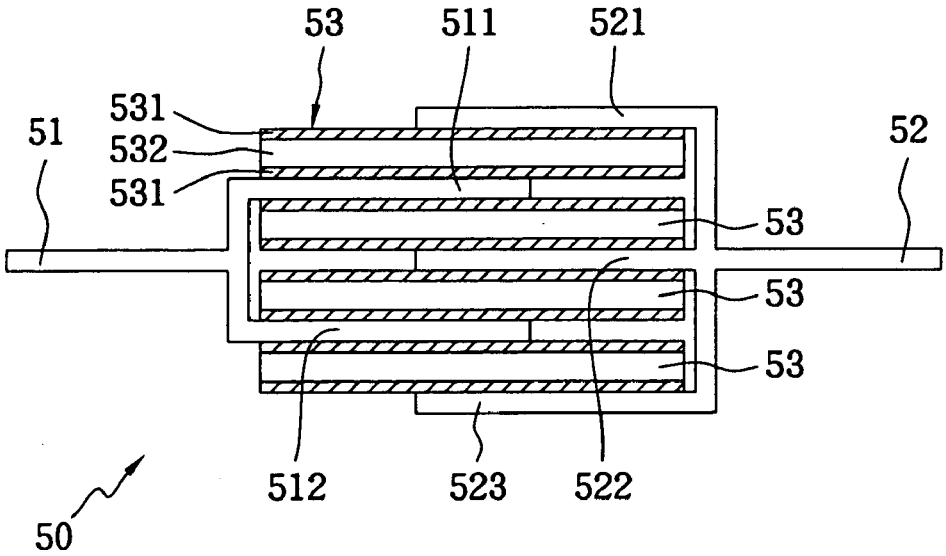
FIG. 5 illustrates an axial leaded over-current protection device of the fourth embodiment in accordance with the present invention.

As shown in FIG. 5, an axial leaded over-current protection device 50 comprises four PTC devices 53, a first terminal metal strip 51 and a second terminal metal strip 52. The PTC device 53 is constituted of two electrode layers 531 and a PTC material layer 532 laminated therebetween. Likewise, one end of the first terminal metal strip 51 diverges into two electrode strips 511 and 512 respectively connected to some of the electrode layers 531 (first electrode layers) of the four PTC devices 53. One end of the second terminal metal strip 52 diverges into three electrode strips 521, 522, and 523, which are respectively connected to the other electrode layers 531 (second electrode layers), i.e., the ones not being connected to the first terminal metal strip 51.

Figure 6:
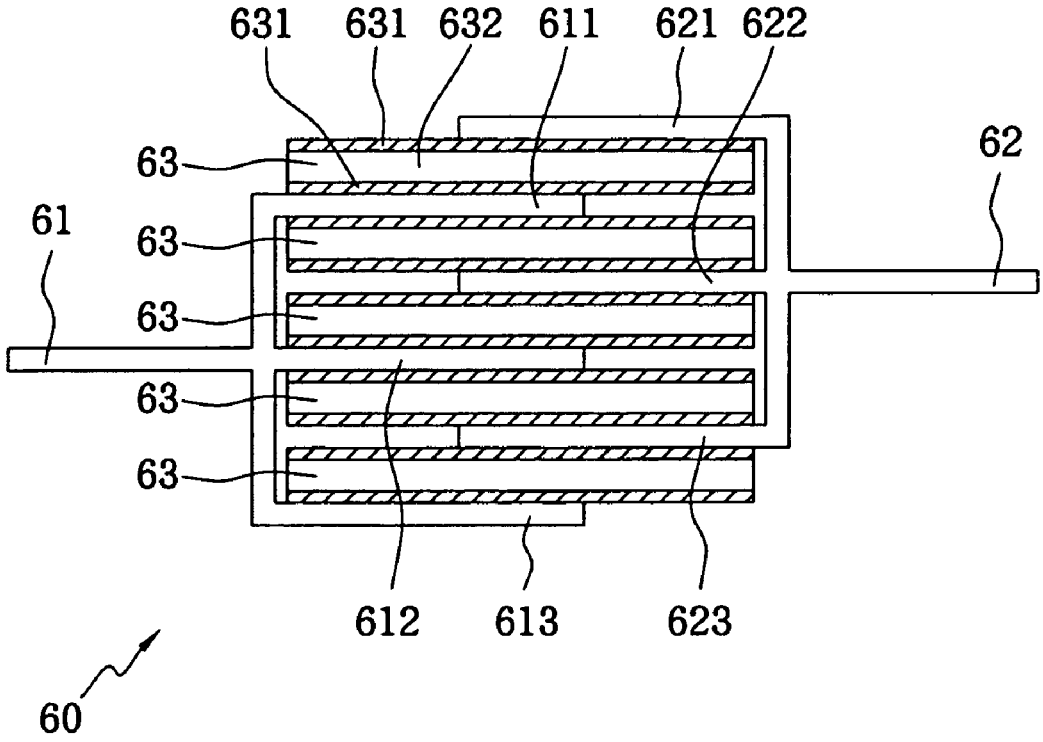
FIG. 6 illustrates an axial leaded over-current protection device of the fifth embodiment in accordance with the present invention.

As shown in FIG. 6, an axial leaded over-current protection device 60 comprises five PTC devices 63, a first terminal metal strip 61 and a second terminal metal strip 62. The PTC device 63 is constituted of two electrode layers 631 and a PTC material layer 632 laminated therebetween. One end of the first terminal metal strip 61 diverges into three electrode strips 611, 612, and 613 respectively connected to some of the electrode layers 631 (first electrode layers) of the five PTC devices 63. One end of the second terminal metal strip 62 also diverges into three electrode strips 621, 622, and 623, which are respectively connected to the other electrode layers 631 (second electrode layers) of the five PTC devices 63, i.e., the ones not being connected to the first terminal metal strip 61.

Figure 7A:
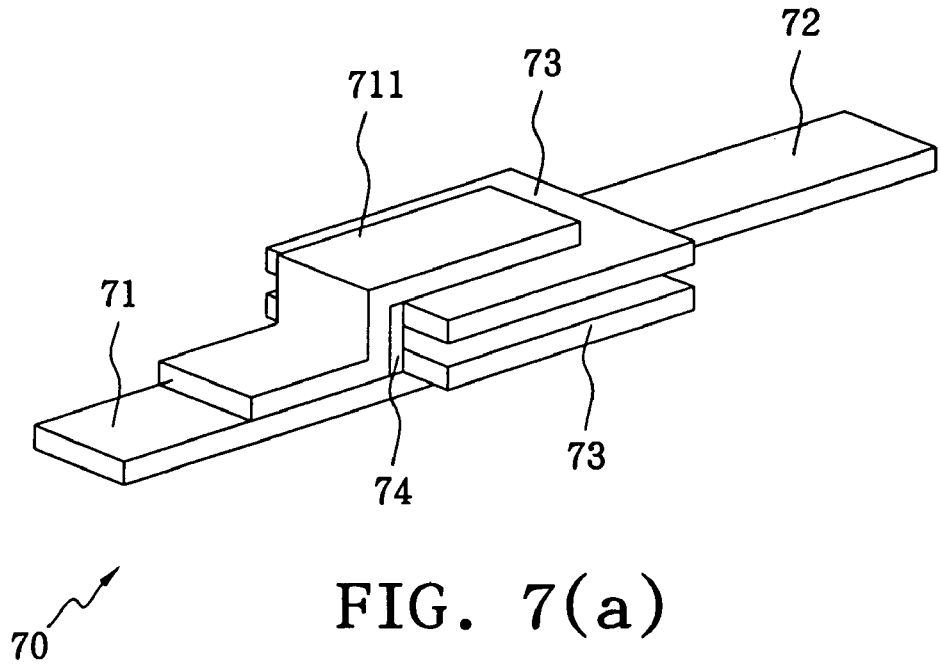
FIGS. 7(*a*) and 7(*b*) illustrate an axial leaded over-current protection device of the sixth embodiment in accordance with the present invention.
Figure 7B:
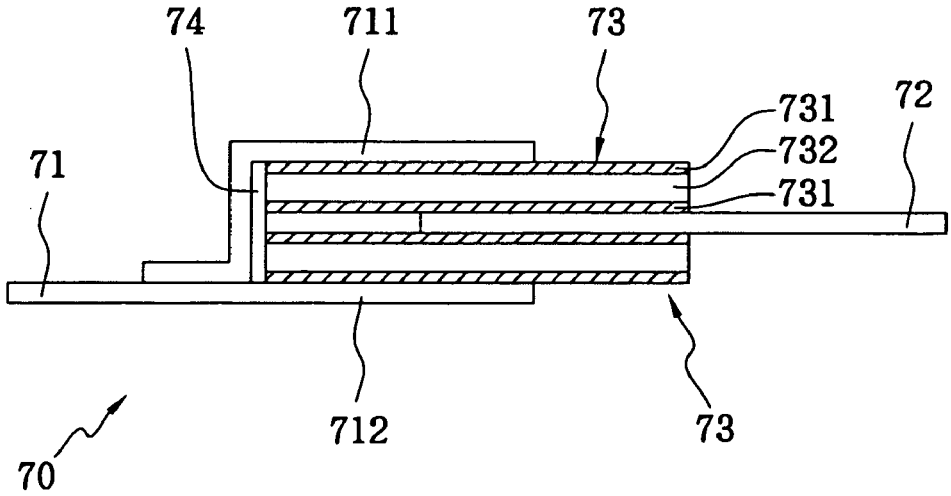

FIG. 7(*a*) illustrates another axial leaded over-current protection device 70 in accordance with the present invention, and FIG. 7(*b*) illustrates the side view of the over-current protection device 70. The over-current protection device 70 comprises a first terminal metal strip 71, a second terminal metal strip 72, and two PTC devices 73. The PTC device 73 is constituted of two electrode layers 731 and a PTC material layer 732 laminated therebetween. One end of the first terminal metal strip 71 diverges into two electrode strips 711 and 712 respectively connected to some of the electrode layers 731 (first electrode layers) of the two PTC devices 73. The electrode strips 711 and 712 are connected by spot-welding or tin-soldering. The electrode strip 711 is provided with an insulation layer 74 to be isolated from the PTC devices 73, so as to avoid an electrical short. The second terminal metal strip 72 is connected to the other electrode layers 731 (second electrode layers), i.e., the ones not being connected to the first terminal metal strip 71. Accordingly, the two PTC devices 73 are connected in parallel, so that the resistance of the over-current protection device 70 will be decreased.

Theoretically, much lower resistance can be obtained by connecting more PTC devices (more than 6) in parallel. However, in view of simplifying structure and manufacturing process, two to six PTC devices connected in parallel are in wide use.

Preferably, the total thickness of a plurality of PTC devices is between 0.7-2.8 mm, and the area of each PTC device is between 10-100 $mm^2$.

The above-described embodiments of the present invention are intended to be illustrative only. Numerous alternative embodiments may be devised by those skilled in the art without departing from the scope of the following claims.

What is claimed is:

1. An axial leaded over-current protection device, comprising:

first and second positive temperature coefficient (PTC) devices which are connected in parallel in a stack strap structure, wherein each PTC device comprises a first electrode layer, a second electrode layer, and a PTC material layer laminated therebetween, wherein the second electrode layer of the first PCT device faces towards the second electrode layer of the second PCT device in the stack strap structure;

a first terminal metal strip including one end that diverges into at least first, second and third electrode strips, wherein the first and second electrode strips are connected to the first electrode layer of the first PCT device, and the third electrode strip is connected to the first electrode layer of the second PCT device; and a second terminal metal strip connected to the second electrode layers of the first and second PTC devices.

2. The over-current protection device of claim 1, wherein the total thickness of the PTC devices is between 0.7 and 2.8 mm.

3. The over-current protection device of claim 1, wherein the area of each PTC device is between 10 and 100 $mm^2$.

4. The over-current protection device of claim 1, further comprising a third PCT device connected in parallel in the stack strap structure and comprising a first electrode layer, a second electrode layer, and a PTC material layer laminated therebetween, wherein the first electrode layer of the third PCT device is connected to first metal terminal strip, and wherein one end of the second terminal metal strip diverges into at least fourth and fifth electrode strip, wherein the fourth electrode strip is connected to the second electrode layer of the first and second PCT devices, and the fifth electrode strip is connect to the second electrode layer of the third PCT device.

5. The over-current protection device of claim 1, further comprised of an insulation layer located between a side of the stack strap structure and the first terminal metal strip.

6. An axial leaded over-current protection device, comprising:

first and second positive temperature coefficient (PCT) devices which are connected in parallel in a stack strap structure, wherein each PTC device comprises a first electrode layer, a second electrode layer, and a PTC material layer laminated therebetween, wherein the second electrode layer of the first PCT device faces towards the second electrode layer of the second PCT device in the stack strap a first terminal metal strip including one end that diverges into at least first and second electrode strips which are soldered to each other, wherein the first electrode strip is connected to the first electrode layer of the first PCT device, and the second electrode strip is connected to the first electrode layer of the second PCT device; and a second terminal metal strip connected to the second electrode layers of the first and second PTC devices.

* * * * *